US005980648A

United States Patent [19]

Adler

[11] Patent Number: 5,980,648

[45] Date of Patent: Nov. 9, 1999

[54] CLEANING OF WORKPIECES HAVING ORGANIC RESIDUES

[75] Inventor: Robert Adler, Gerasdorf, Austria

[73] Assignee: Union Industrie Comprimierter Gase GmbH NFG. KG, Vienna, Austria

[21] Appl. No.: 08/107,696

[22] PCT Filed: Feb. 14, 1992

[86] PCT No.: PCT/EP92/00322

§ 371 Date: Dec. 30, 1993

§ 102(e) Date: Dec. 30, 1993

[87] PCT Pub. No.: WO92/14558

PCT Pub. Date: Sep. 3, 1992

[30] Foreign Application Priority Data

Feb. 19, 1991 [AT] Austria ..... 342/91

[51] Int. Cl.[6] ..... B08B 3/00

[52] U.S. Cl. ..... 134/34; 134/37; 134/25.1; 134/102.2; 134/105; 134/108; 134/109; 134/11; 134/7

[58] Field of Search ..... 134/11, 7, 34, 134/37, 42, 25.1, 102.2, 105, 108, 109

[56] References Cited

U.S. PATENT DOCUMENTS

| | | | |
|---|---|---|---|
| 3,900,551 | 8/1975 | Bardoncelli et al. | 423/9 |
| 4,944,837 | 7/1990 | Nishikawa et al. | 156/646 |
| 5,174,917 | 12/1992 | Monzyk | 252/60 |
| 5,213,619 | 5/1993 | Jackson et al. | 134/1 |
| 5,306,350 | 4/1994 | Hoy et al. | 134/22.14 |

FOREIGN PATENT DOCUMENTS

| | | |
|---|---|---|
| 0283740 | 9/1988 | European Pat. Off. . |
| 0302345 | 2/1989 | European Pat. Off. . |
| 0370233 | 5/1990 | European Pat. Off. . |
| WO90/06189 | 6/1990 | WIPO . |
| 9013675 | 11/1990 | WIPO . |

*Primary Examiner*—Zeinab El-Arini

*Attorney, Agent, or Firm*—Millen, White, Zelano & Branigan, P.C.

[57] ABSTRACT

The process concerns the cleaning of workpieces exhibiting organic residues, with the use of a fluid introduced under pressure into a pressure tank loaded with the workpieces. According to the invention, the fluid is circulated during the cleaning step, using preferably liquefied gases, e.g. carbon dioxde, as the fluid. By the use of a heat exchanger, the temperature of the fluid can be regulated during the process.

30 Claims, 1 Drawing Sheet

CLEANING OF WORKPIECES HAVING ORGANIC RESIDUES

Figure 1:
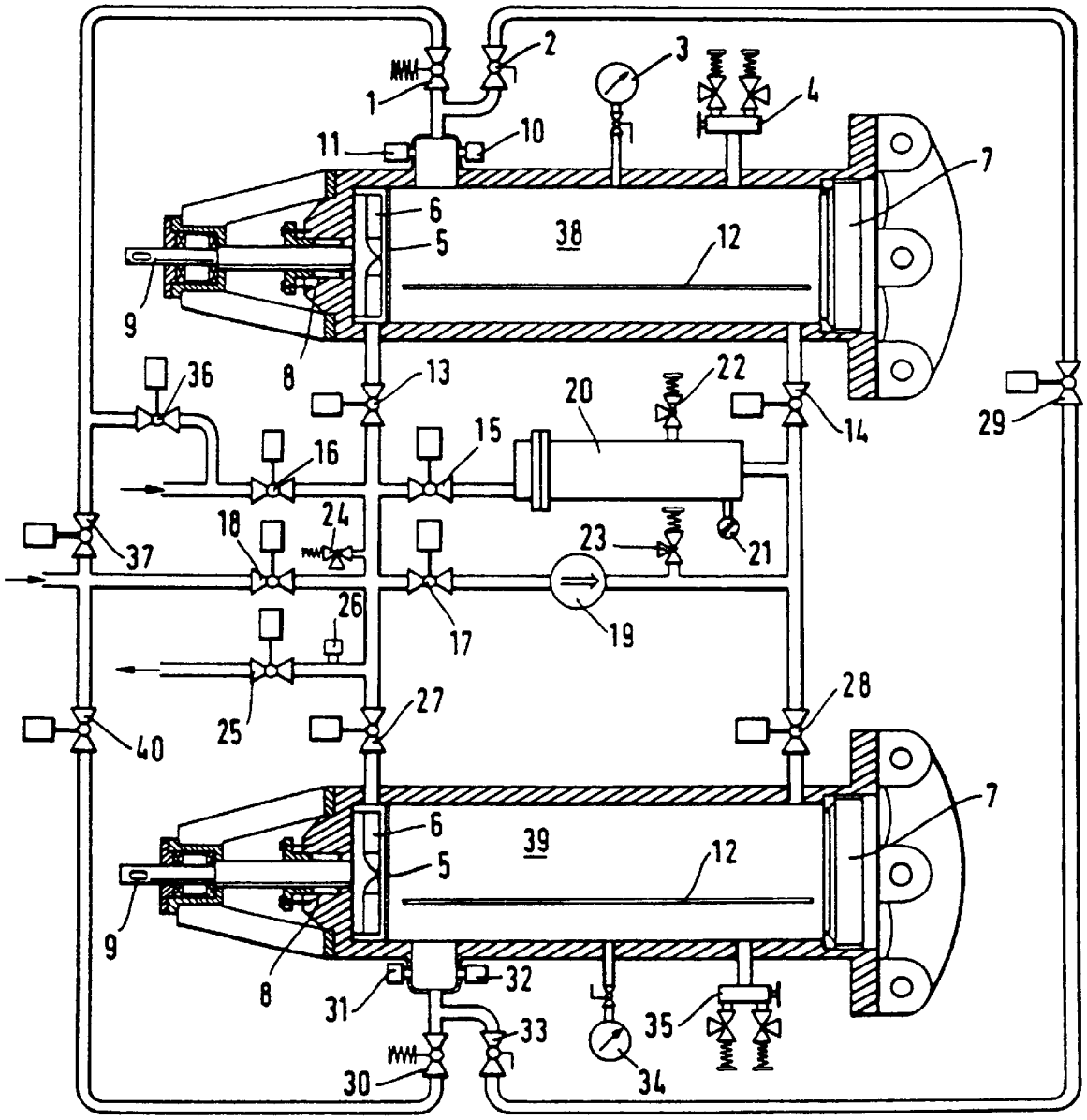

This is a national stage application of PCT/EP92/0032 filed Feb. 14, 1992.

The invention relates to a process for cleaning workpieces exhibiting organic residues, with the use of a fluid introduced under pressure into a pressure tank loaded with the workpieces.

In a process for cleaning workpieces of various materials contaminated with residues of oil, grease, lubricant, etc., as known from WO 90 06 189, a gas compressed to its supercritical pressure or thereabove is conducted onto the workpieces to be cleaned in a pressure tank. Subsequently, the temperature of the thus-compressed gas is varied, starting with a point in the proximity of the critical temperature, in various steps, in order to influence the dissolving properties of the gaseous phase. Before each change, the temperature is kept constant for a specific time interval. Cleaning of the workpieces can furthermore be additionally enhanced by introducing into the compressed gas a liquid, such as deionized water, a chemically reactive compound, or sound or radiation energy.

The above-described measures enhancing the cleaning of the workpieces require technically expensive extra equipment and furthermore show little effectiveness. The costs to be expended are not justified by increased cleaning efficacy.

The process according to WO 90 06 189 additionally necessitates great expenditure with respect to regulating technique. The individual steps wherein the temperature is altered succeed one another at a time interval of about 10 minutes. In the meantime, the temperature must be kept constant. Consequently, care must be taken that, within a minimum time, in each case a new temperature must be set and then maintained constant in a large pressure vessel. The expensive equipment needed for this purpose, not described in any detail in WO 90 06 189, renders such a cleaning process less than attractive for industrial application.

A further drawback of this process occurs during emptying of the pressure tank. The gas mass compressed to supercritical pressure contains the residual compounds in solution after the cleaning step. In order to avoid settling of these residual compounds in the pressure tank during the removal of this mass of gas from the pressure tank, the pressure and temperature of the mass of gas must be kept constant while it is removed. For this purpose, pure gas compressed to supercritical pressure is replenished while the contaminated gas is discharged from the pressure tank. Only after the entire content of the tank consisting of contaminated gas has thus been removed is it possible to lower the pressure and to take out the workpieces. In this process, it is highly probable that the contaminated gas mass has merely been diluted, rather than replaced, and that during lowering of the pressure the remaining, dissolved residual compounds will again be precipitated. Additionally, exchanging of the entire content of the tank after each cleaning step is not economical.

Therefore, the invention is based on the object of developing a process for cleaning workpieces contaminated with organic residues with the use of a fluid, avoiding the aforementioned disadvantages and increasing the success of the cleaning procedure in an economical fashion.

This object has been attained according to the invention by circulating the fluid in the pressure tank during the cleaning step.

The process of this invention represents a simple measure considerably enhancing the cleaning operation. The fluid, understood to mean a gaseous, liquid or also supercritical substance, is mechanically circulated in the pressure tank, for example, by the rotation of a vane-equipped impeller. The thus-initiated flow of fluid in the pressure tank brings about a continuous exchange of pure fluid and of fluid loaded with dissolved impurities. Thereby, the organic residues adhering to the workpiece surfaces can be successively removed in their entirety.

In order to vary the flow profile in the pressure tank with time, the circulating velocity is advantageously varied during the cleaning step. This change can take place, for example, by cyclically varying the number of revolutions of an impeller producing the circulation. In this case, the result is achieved that the suction zones and pressurized zones of the fluid, produced during the circulation, are altered in their cross section, and that simultaneously an effect can be exerted on the velocity distribution of the fluid. This feature prevents the formation of regions in the pressure tank wherein, at a constant speed of the impeller, no fluid circulation would occur.

The use of a liquefied gas as the fluid is advantageous; this gas is conducted into the pressure tank at a suitable pressure, dissolves the residual compounds off the workpiece surfaces in the tank, and forms a unitary phase with these compounds.

In general, it can be stated that the presence of a certain fluid density is a prerequisite and a determining factor for its dissolving power which latter then increases with increasing density. With a constant density of the fluid, the solubility generally increases with a rising temperature of the fluid.

Determining factors for the solubility of the substance in the fluid are, besides the vapor pressure of the substance to be dissolved and the density and temperature of the fluid, also polarity and molecular weight of the substance, as well as viscosity, diffusion coefficient, critical point, and dipole moment of the fluid, along with the molecular interactions of this fluid with the substance. Simple, generally valid rules cannot be established for different substances and fluids.

Suitable fluids for removing organic residues are, for example, noble gases, such as helium or argon, hydrocarbons, i.e., for example, alkanes, such as methane, ethane or propane, or alkenes, such as ethene or propene, as well as trifluoromethane, carbon dioxide, nitrous oxide, and sulfur hexafluoride. Gaseous fluids are advantageously compressed into the liquid phase and introduced into the pressure tank loaded with the workpieces.

Carbon dioxide proved to be an especially suitable fluid in the process of this invention since it exhibits the following advantages:

Carbon dioxide is not flammable or explosive; carbon dioxide is cheaply available in large amounts as a by-product of industrial processes; carbon dioxide, in contrast to other solvents, exerts a low stress on the environment; and carbon dioxide has a chemically inert behavior. Besides, the thermodynamic properties of carbon dioxide are favorable for the process according to this invention.

A suitable measure in conducting the process of the invention resides in keeping the temperature of the fluid in the pressure tank constant during the cleaning step. According to the invention, the suitable parameters, temperature and pressure of the fluid, for removing the organic residues are first determined in preliminary tests. These parameters are then maintained constant during the cleaning procedure. For this purpose, in an advantageous embodiment, a portion of the fluid is continuously withdrawn from the pressure tank, passed through a heat exchanger, and subsequently reintroduced into the pressure tank. Heating of the fluid may be necessary during long-term cleaning processes in pressure tanks that are not thermally insulated; on the other hand, cooling of the fluid may be needed, above all in heat-insulated containers if the energy supplied for the circulation of the fluid heats up the latter.

Of course, the heat exchange of the fluid is also suitable for covering a specific temperature range during the cleaning step if this should be necessary.

An improper pressure rise can be prevented depending on the physical condition of the fluid by means of a pressure relief valve or by means of an overflow regulator at the pressure tank.

After the cleaning step, the fluid contaminated with the organic residues must be removed from the pressure tank; the cleaned workpieces are discharged subsequently.

When removing the fluid, care must be taken that pressure and temperature in the pressure tank do not vary substantially since otherwise the resultant change in the dissolving properties of the fluid would lead to precipitation of the residues dissolved in the fluid. For this reason, it is advantageous to keep the temperature of the fluid constant after the cleaning step during the removal of the fluid containing the organic residues from the pressure tank. Furthermore, it is advantageous according to the process of this invention to feed pure fluid into the pressure tank during the removal of the fluid containing the organic residues from the pressure tank and to keep the pressure constant, or increase the pressure, during this step.

The fluid containing the residues, thus discharged from the pressure tank, is then expanded whereby the organic residues are separated from the fluid. The expansion brings about a separation of the binary phase consisting of the fluid and the organic residues because the organic residues pass over almost entirely into a liquid phase whereas the fluid is present in most cases in the gaseous phase. In case of carbon dioxide, the expansion additionally results in a solid phase in the form of carbon dioxide snow.

In an advantageous embodiment of the process according to this invention, the potential energy of the fluid liberated during expansion is utilized for driving a turbine. By this feature, a portion of the energy expended for the cleaning operation can be recovered, and the energetic degree of efficiency of the cleaning facility can be increased.

In order to render the cleaning process proper more economical, it is advantageous to separate the organic residues from at least a portion of the fluid containing the organic residues and to utilize the remaining portion, together with pure fluid, for a further cleaning step. For in many instances the fluid mass present in the pressure tank can be exploited for several cleaning steps before it is saturated with the organic residues. Consequently, it suffices to replace, after each cleaning step, respectively only a part of the fluid used by pure fluid without there being any marked reduction in the cleaning capacity and velocity. By virtue of this feature, the consumption and the costs for providing the amount of fluid required for cleaning are sensibly restricted.

A suitable apparatus for performing the process according to the invention is characterized in that a first cylindrical pressure tank contains an impeller attached to its axle within the pressure tank; that the first pressure tank is connected with an analogously equipped second pressure tank by way of conduits provided with valves; that a pump is arranged in one of the connecting conduits, and a heat exchanger is arranged in this pump or in another connecting conduit, wherein the heat exchanger and the pump are each connected with each pressure tank by additional conduits; and that each pressure tank is connected with one or several storage tanks for fluids by means of additional conduits.

A concrete embodiment of the process according to this invention will be discussed in detail with reference to the schematic drawing.

In the embodiment, two pressure tanks 38, 39 are utilized. Each pressure tank 38, 39 contains an impeller 6 effecting the circulation of the fluid and separated by a protective screen 5 from the remaining interior of the pressure tank 38, 39. The impeller 6 is driven externally of the pressure tank 38, 39 via the shaft 9 and is supported in a stuffing bush 8.

Within the pressure tank 38, 39, a fixedly mounted guide rail 12 is located for a tubular slide carrying the workpieces to be cleaned. The pressure tank 38, 39 is tightly sealed by a high-pressure lid 7.

Each pressure tank 38, 39 furthermore contains a manometer 3, 34 and safety valve units 4, 35, as well as respectively one level sensor 10, 31 and a pressure switch 11, 32. The pressure tanks 38, 39 are in communication with each other via several conduits. A direct connecting conduit contains two shutoff ball cocks 2, 33 and a motor-driven control valve 29.

A heat exchanger 20 is connected by means of conduits via the motor-driven control valves 13, 15, 14 with the pressure tank 38 and via the control valves 27, 15, 28 with the pressure tank 39.

This heat exchanger 20 contains a temperature regulator 21 and a safety valve 22.

A pump 19 is connected by means of conduits via the motor-driven control valves 13, 17, 14 with the pressure tank 38 and via the control valves 27, 17, 28 with the pressure tank 39.

A safety valve 23 is likewise arranged in the pump conduit.

Furthermore, both pressure tanks 38, 39 are connected with each other by conduits by way of the heat exchanger 20 and the control valves 13, 15, 28, as well as by way of the pump 19 and the control valves 13, 17, 28.

In the embodiment, a storage tank, not shown in the drawing, for a fluid is utilized wherein the latter is present under pressure in compressed and partially liquefied form. The fluid can be withdrawn from the top section of this storage tank in the gaseous phase, from the bottom section of this storage tank in the liquid phase, and can be introduced into the two pressure tanks 38, 39.

In particular, the gaseous fluid can be conducted via the heat exchanger 20 by way of the control valves 16, 15, 14 into the pressure tank 38 and by way of the control valves 16, 15, 28 into the pressure tank 39. The liquid fluid is fed via the pump 19 by way of the control valves 18, 17, 14 to the pressure tank 38 and by way of the control valves 18, 17, 28 to the pressure tank 39.

Conversely, fluid can be returned from the pressure tank 38 into the storage tank. In particular, gaseous fluid can be returned via the overflow regulator 1 and the control valve 36, and liquid fluid via the overflow regulator 1 and the control valve 37 into the storage tank.

As can be seen from the drawing, fluid can be returned into the storage tank from the pressure tank 39 in a completely analogous fashion.

Finally, the apparatus of this invention comprises a venting facility wherein the dissolved organic residues are separated from the fluid by expansion. The fluid can furthermore be conducted into a turbine which renders part of the energy liberated during expansion reusable in that it converts this energy into rotational energy and utilizes the latter for current generation.

This venting facility, not illustrated in the drawing, is connected to the conduit system between the two pressure tanks 38, 39 by way of a probe for liquid fluid 26 and a motor-driven control valve 25. Consequently, fluid exhausted after the cleaning step can be conducted from the pressure tanks 38, 39 into the venting facility.

The process according to this invention serves, in the embodiment, for cleaning just-manufactured copper tubes, the surfaces of which are coated with drawing grease from the manufacturing procedure. Approximately 700 to 800 copper tubes are loaded onto respectively one tubular slide, and these slides are then moved on the guide rails 12 into the two pressure tanks 38, 39. Then the high-pressure lids 7 are sealed.

Commercially available carbon dioxide is utilized as the fluid, withdrawn from a storage tank under pressure at a room temperature of about 298 Kelvin. The carbon dioxide flows in the gaseous phase through the conduits into the pressure tank 38 with the control valves 16, 15 and 14 being opened, until pressure equalization has been obtained with the storage tank. In order to prevent cooling of the carbon dioxide during expansion of the carbon dioxide gas, the temperature of the gas is kept constant at about 298 Kelvin by the heat exchanger 20. The pressure of the carbon dioxide gas at this temperature then is about 64 bar in the pressure tank 38. Cooling of the gas should be prevented inasmuch as this would lead to congealing of the oily residues adhering to the tubes and would thereby make the cleaning process more difficult.

The pressure tank 38 is thus initially pressurized. Now liquid carbon dioxide can be passed into the pressure tank 38 without there being an expansion of the liquefied gas. The communication to the top section of the storage tank is sealed off, the control valves 18, 17 and 14 are opened, and liquid carbon dioxide is conducted from the bottom section of the storage tank via the pump 19 into the pressure tank 38. The carbon dioxide gas, during this step, is forced back into the storage tank by the inflowing liquid from the pressure tank 38 via the overflow regulator 1, with the control valve 36 being open. The level sensor 10 shuts off the pump 19 once the desired filling level has been attained.

The pressure tank 38 is now filled with liquid carbon dioxide. In preliminary tests, good cleaning results were achieved at temperatures of between 298 Kelvin and 304 Kelvin, the pressure being somewhat above the corresponding vapor pressure values. Corresponding conditions are now established in the pressure tank 38; the temperature of the liquid carbon dioxide can be regulated with the aid of heat exchanger 20. According to the invention, the cleaning process is performed by circulating the liquid carbon dioxide in the pressure tank 38. The impeller 6 is driven by way of the shaft 9, the number of revolutions of the impeller 6 being cyclically varied by means of a time control. Thereby, the zone wherein no circulation takes place at constant speed is shifted over the diameter of the pressure tank 38. The circulating action causes a stream of carbon dioxide conducting continuously new amounts of carbon dioxide to the tube surfaces whereby the dissolving capacity of the entire volume of carbon dioxide in the pressure tank 38 can be exploited, and the cleaning step proceeds substantially faster and more efficient than in case of stationary contact. The oily residues on the copper tubing are detached and pass over into a unitary phase with the liquid carbon dioxide.

The frictional heat produced by fluid circulation leads to an excess pressure which can be relieved by means of the overflow regulator 1. Small amounts of liquid carbon dioxide are then forced back into the supply conduit with the control valve 37 being open. If thereby relatively large amounts of contaminated carbon dioxide should pass into this supply conduit, it is advisable to connect a separate storage tank to this supply line during the cleaning process in order to avoid influx of contaminated carbon dioxide into the carbon dioxide storage tank.

According to the invention, it is possible for maintaining a constant temperature of the fluid during the cleaning step in the pressure tank to conduct a portion of the fluid continuously through the heat exchanger 20 by opening the control valves 13, 15 and 14. This ensures that the dissolving properties of the liquid carbon dioxide will not be altered undesirably during the cleaning step.

In this embodiment, the cleaning step takes approximately one-half hour. In general, this time period is varied in dependence on the extent of contamination of the copper tubes.

Once the cleaning step in the pressure tank 38 is finished, pressurizing of the pressure tank 39 is begun. For this purpose, gaseous carbon dioxide is conducted from the storage tank via the heat exchanger 20 into the pressure tank 39 with the valves 16, 15 and 28 being open. Subsequently, liquid carbon dioxide is pumped from the storage tank via the pump 19 into the pressure tank 39 with the valves 18, 17 and 28 being opened. However, this time only a part of the tank volume is filled with liquid carbon dioxide. This part is dimensioned in accordance with the number of cleaning steps required for saturating the entire amount of liquid carbon dioxide in the tank with the oil residues. In this embodiment, this number is about 7 to 8 cleaning steps, i.e. it is sufficient to prefill approximately the seventh to eighth part of the tank volume with pure liquid carbon dioxide during the respectively subsequent cleaning step. The remaining quantity is reused from the preceding cleaning step. For this purpose, the valves 13, 17 and 28 are opened, and liquid carbon dioxide, now already containing the oily residues in solution, is pumped from the pressure tank 38 into the pressure tank 39. The gas utilized for pressurizing the pressure tank 39 is conducted into the pressure tank 38 during this procedure. For this purpose, the shutoff ball cocks 33 and 2 as well as the control valve 29 are opened up.

The level sensor 31 terminates the filling step with liquid carbon dioxide. The cleaning step then takes place in the pressure tank 39 in a completely analogous way as already described for the pressure tank 38.

The pressure tank 38 contains the cleaned copper tubes, the remaining quantity of liquid carbon dioxide containing the oily residues, as well as the pure carbon dioxide gas introduced for maintaining the pressure. This carbon dioxide gas, introduced into pressure tank 39 from pressure tank 38, causes an excess pressure ranging above the excess pressure prevailing during the cleaning step, on account of the remaining amount of liquid in the pressure tank 38, whereby it is ensured during the subsequent removal of the liquid carbon dioxide containing the oil residues that the latter remain dissolved in the liquid carbon dioxide. This is so because thereby no expansion of the liquid carbon dioxide can take place to pressures ranging lower than during the cleaning step.

Upon opening the control valves 13 and 25, this amount of contaminated liquid carbon dioxide is exhausted from the pressure tank 38 into the venting facility. This process is finished once the liquid carbon dioxide probe 26 no longer records any throughflow of liquid carbon dioxide.

In order to remove the workpieces from the pressure tank 38, the pressure must be lowered to atmospheric pressure. For this purpose, the circulation of the gas is initiated when the probe 26 registers only gaseous carbon dioxide any more. The valves 13, 15 and 14 are then opened, and a portion of the gas is conducted through the heat exchanger 20 on account of the flow pressure produced during circulation. At the same time, the valve 25 remains open so that a component stream of the gas is exhausted from the pressure tank 38. On account of these measures, pressure lowering occurs at a temperature that is maintained constant. A sudden expansion of the carbon dioxide gas to normal pressure is accordingly prevented; such an event would cause the formation of carbon dioxide snow and therefore also a strong cooling of the system.

Expansion takes place in the venting facility during the discharging of the liquid carbon dioxide containing the oily residues. The carbon dioxide can here be conducted over a simple oil separator wherein the oily residues are collected which have congealed and precipitated on account of the strong cooling of the carbon dioxide during expansion, and wherein the carbon dioxide is obtained as gas and snow which latter is soon sublimed.

Introduction of the carbon dioxide into a condensation turbine is more advantageous; this turbine is operated with the energy released during expansion and can supply a portion of the current for operation of the heat exchanger 20.

The effluent carbon dioxide gas, freed of the oily residues, can, of course, be passed again to a storage tank after compression.

This embodiment demonstrates the economical course of the process according to this invention, achieving good cleaning results.

I claim:

1. In a process for cleaning workpieces exhibiting organic residues, comprising introducing compressed gas under pressure into a pressure tank loaded with the workpieces, the improvement wherein:

a liquefied or supercritical gas having a temperature is mechanically circulated within the pressure tank during cleaning of the workpieces whereby the mechanically circulated liquefied or supercritical gas exhibits a circulation velocity and said circulation velocity of said liquefied or supercritical gas is varied during said cleaning, and wherein said temperature of said liquefied or supercritical gas in the pressure tank is maintained constant during said cleaning.

2. A process according to claim 1, wherein said liquefied or supercritical gas is carbon dioxide.

3. A process according to claim 2, wherein, during said cleaning, a portion of the liquefied or supercritical gas is continuously withdrawn from the pressure tank, is conducted through a heat exchanger, and is subsequently reintroduced into the pressure tank.

4. A process according to claim 3, wherein said liquefied or supercritical gas is mechanically circulated in said pressure tank by an impellar.

5. A process according to claim 1, wherein said liquefied or supercritical gas is mechanically circulated in said pressure tank by an impellar.

6. A process according to claim 1, wherein, during said cleaning, a portion of the liquefied or supercritical gas is continuously withdrawn from the pressure tank, conducted through a heat exchanger, and subsequently reintroduced into the pressure tank.

7. A process according to claim 6, wherein carbon dioxide is utilized as the liquefied or supercritical gas.

8. A process according to claim 7, wherein, during said cleaning, a portion of the liquefied or supercritical gas is continuously withdrawn from the pressure tank, is conducted through a heat exchanger, and is subsequently reintroduced into the pressure tank.

9. A process according to claim 8, wherein said liquefied or supercritical gas is mechanically circulated in said pressure tank by an impellar.

10. A process according to claim 7, wherein said liquefied or supercritical gas is mechanically circulated in said pressure tank by an impellar.

11. A process according to claim 6, wherein said liquefied or supercritical gas is mechanically circulated in said pressure tank by an impeller.

12. A process according to claim 1, wherein, after said cleaning, the temperature of the liquefied or supercritical gas is kept constant during removal of the liquefied or supercritical gas containing the organic residues from the pressure tank.

13. A process according to claim 12, wherein, during said cleaning, a portion of the liquefied or supercritical gas is continuously withdrawn from the pressure tank, is conducted through a heat exchanger, and is subsequently reintroduced into the pressure tank.

14. A process according to claim 13, wherein said liquefied or supercritical gas is mechanically circulated in said pressure tank by an impellar.

15. A process according to claim 12, wherein said liquefied or supercritical gas is mechanically circulated in said pressure tank by an impellar.

16. A process according to claim 1, wherein, after said cleaning, pure liquefied or supercritical gas is introduced into the pressure tank during removal of the liquefied or supercritical gas containing the organic residues from the pressure tank and the pressure is kept constant or is increased during said removal.

17. A process according to claim 16, wherein, during said cleaning, a portion of the liquefied or supercritical gas is continuously withdrawn from the pressure tank, is conducted through a heat exchanger, and is subsequently reintroduced into the pressure tank.

18. A process according to claim 17, wherein said liquefied or supercritical gas is mechanically circulated in said pressure tank by an impellar.

19. A process according to claim 16, wherein said liquefied or supercritical gas is mechanically circulated in said pressure tank by an impellar.

20. A process according to claim 1, wherein the organic residues are separated from the liquefied or supercritical gas containing the organic residues by expansion.

21. A process according to claim 20, wherein the liquefied or supercritical gas liberated during said expansion is used to drive a turbine.

22. A process according to claim 21, wherein said liquefied or supercritical gas is mechanically circulated in said pressure tank by an impellar.

23. A process according to claim 20, wherein said liquefied or supercritical gas is mechanically circulated in said pressure tank by an impellar.

24. A process according to claim 1, wherein the organic residues are separated from at least a portion of the liquefied or supercritical gas containing the organic residues, and the remaining portion is utilized for a further cleaning step together with sure liquefied or supercritical gas.

25. A process according to claim 24, wherein said liquefied or supercritical gas is mechanically circulated in said pressure tank by an impellar.

26. A process according to claim 1, wherein said liquefied or supercritical gas is a noble gas, an alkane, an alkene, trifluoromethane, carbon dioxide, nitrous oxide or sulfur hexafluoride.

27. A process according to claim 26, wherein said liquefied or supercritical gas is mechanically circulated in said pressure tank by an impellar.

28. A process according to claim 1, wherein said liquefied or supercritical gas is mechanically circulated in said pressure tank by an impellar.

29. An apparatus for cleaning workpieces contaminated with organic residues said apparatus comprising:

a first cylindrical pressure tank containing an impeller mounted on an axle within said first cylindrical pressure tank; said first cylindrical pressure tank is connected via conduits provided with valves with a second cylindrical pressure tank containing an impellar mounted on an axle within said second pressure tank; one of said conduits is provided with a pump, and a heat exchanger is positioned in this or another connecting conduit wherein said heat exchanger and said pump are connected with each pressure tank respectively by additional conduits; and that each pressure tank is connected by means of additional conduits with one or several storage tanks for compressed gases.

30. In a process for cleaning workpieces exhibiting organic residues, comprising introducing compressed gas under pressure into a pressure tank loaded with the workpieces, the improvement wherein:

a liquefied or supercritical gas having a temperature is mechanically circulated within the pressure tank during cleaning of the workpieces whereby The mechanically circulated liquefied or supercritical gas exhibits a circulation velocity and said circulation velocity of said liquefied or supercritical gas is varied during said cleaning, wherein during said cleaning the temperature of the liquefied or supercritical gas is not varied stepwise to influence dissolving properties of said liquefied or supercritical gas.

* * * * *